United States Patent [19]

Baron

[11] 4,044,903

[45] Aug. 30, 1977

[54] SPECIFIC LINKAGE ARRANGEMENT FOR BUCKET CONTROL

[75] Inventor: George B. Baron, Marion, Ohio

[73] Assignee: Marion Power Shovel Company, Inc., Marion, Ohio

[21] Appl. No.: 559,963

[22] Filed: Mar. 19, 1975

[51] Int. Cl.[2] ..... E02F 3/62

[52] U.S. Cl. ..... 214/138 R; 37/118 A; 214/763; 214/769

[58] Field of Search ..... 37/116, 1, 103, 118A; 214/138 R, 135 R, 135 A, 136, 137, 778, 131 R, 763, 769, 770, 773, 777

[56] References Cited

U.S. PATENT DOCUMENTS

| | | | |
|---|---|---|---|
| 649,244 | 5/1900 | Hetlesaeter | 214/136 |
| 649,245 | 5/1900 | Hetlesaeter | 214/136 |
| 1,622,239 | 3/1927 | Orton | 214/135 R |
| 3,169,649 | 2/1965 | Brocklebank et al. | 214/138 R |
| 3,501,034 | 3/1970 | Baron | 214/138 R |
| 3,570,691 | 3/1971 | Guinot | 214/778 X |
| 3,648,863 | 3/1972 | Baron et al. | 214/138 R |
| 3,856,161 | 12/1974 | Baron | 214/138 R |

FOREIGN PATENT DOCUMENTS

| | | | |
|---|---|---|---|
| 1,634,850 | 7/1970 | Germany | 214/138 R |
| 1,127,823 | 4/1962 | Germany | 214/138 R |
| 139,993 | 2/1961 | U.S.S.R. | 214/138 R |
| 215,105 | 7/1967 | U.S.S.R. | 214/138 |

*Primary Examiner*—Edgar S. Burr
*Assistant Examiner*—Steven A. Bratlie
*Attorney, Agent, or Firm*—Mason, Fenwick & Lawrence

[57] ABSTRACT

A power shovel including a stiffleg, a dipper handle operatively connected to the stiffleg, a dipper having a forwardly disposed digging end pivotally connected to the dipper handle, the dipper being biased to pitch the forwardly disposed digging end thereof upwardly, means for limiting the upward pitch of the digging end of the dipper relative to the dipper handle, a hoist frame pivotally connected to the stiffleg, and a hoist link pivotally connected at the ends thereof to the hoist frame and to the dipper defining a four bar linkage. Such linkage is provided with a geometry wherein the point of intersection of the longitudinal centerlines of the hoist link and the dipper handle is confined to the third quadrant of a set of coordinates having the center of gravity of the dipper and any material disposed therein defining the origin of the set of coordinates, the coordinates being parallel and perpendicular to a longitudinal centerline of the dipper and the third quadrant thereof including the forwardly disposed digging end of the dipper, and the point of intersection is positioned inwardly of the plane of the bottom surface of the dipper when the dipper is in a retracted position, pitched upwardly and restrained by the pitch limiting means.

14 Claims, 3 Drawing Figures

SPECIFIC LINKAGE ARRANGEMENT FOR BUCKET CONTROL

Figure 1:
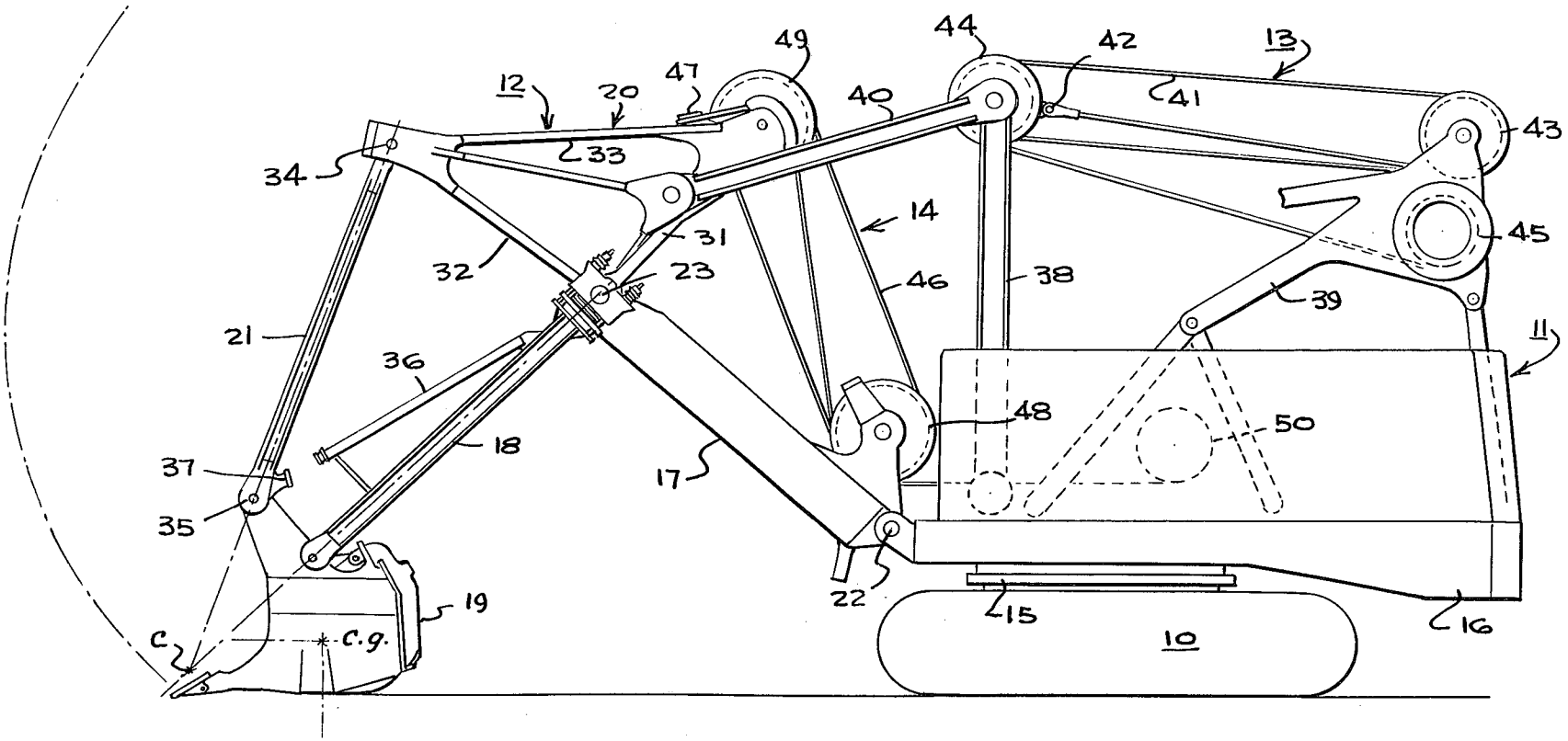

The present invention relates to a power shovel of the type disclosed in U.S. Pat. Nos. 3,501,034; 3,648,863 and 3,856,161 which generally include a lower frame mounted on a crawler assembly, an upper frame rotatably mounted on the lower frame, a front end assembly including a stiffleg pivotally connected at a lower end thereof to the upper frame, a dipper handle operatively connected to the stiffleg, a dipper pivotally connected to the dipper handle, a hoist frame pivotally connected to the stiffleg and a hoist link pivotally connected at the ends thereof to the hoist frame and the dipper handle. In addition, there is provided in such type of shovel, a crowd system mounted on the upper frame and operatively connected to the front end assembly, a hoist system mounted on the upper frame and operatively connected to the front end assembly, and control means also mounted on the upper frame for operating the crowd and hoist systems to crowd, hoist, lower and retract the dipper. Additionally, there normally is provided a mechanism for controlling the pitch of the dipper during the crowding phase of the dipping cycle of such a shovel to provide a horizontal pass of the dipper for efficiency in filling of the dipper, thus maximizing the operating efficiency of the shovel.

In such type of power shovel, it as been found to be desirable to eliminate the pitch control mechanism, while maintaining the capability of maintaining a substantially horizontal attitude of the dipper during crowding thereof thus assuring the same or approaching the efficiency of a similar shovel provided with a pitch control mechanism.

Accordingly, it is the principal object of the present invention to provide a novel power shovel.

Another object of the present invention is to provide a power shovel wherein the dipper thereof is capable of maintaining a horizontal attitude during the crowding thereof, thus enhancing the operating efficiency of the shovel.

A further object of the present invention is to provide a novel power shovel wherein the dipper thereof is capable of maintaining a substantially horizontal attitude during the crowding thereof, thus enchancing the operating efficiency of the shovel, without the use of a mechanism for varying the pitch of the dipper relative to the dipper handle to maintain such substantially horizontal attitude of the dipper.

A still further object of the present invention is to provide a novel power shovel including a stiffleg, a dipper handle operatively connected to the stiffleg, a dipper pivotally connected to the dipper handle, a hoist frame pivotally connected to the stiffleg, and a hoist link pivotally connected at the ends thereof to the dipper and the hoist frame, wherein the dipper is capable of maintaining a substantially horizontal attitude during the crowding thereof, thus enhancing the operating efficiency of the shovel.

Another object of the present invention is to provide a novel power shovel having a stiffleg, a dipper handle operatively connected to the stiffleg, a dipper pivotally connected to the dipper handle, a hoist frame pivotally connected to the stiffleg and a hoist link pivotally connected at the ends thereof to the dipper and the hoist frame, wherein the dipper is capable of maintaining a substantially horizontal attitude during the crowding thereof without the use of a mechanism for varying the pitch of the dipper relative to the dipper handle during the crowding of the dipper.

A further object of the present invention is to provide a novel power shovel which is comparatively simple in construction, comparatively inexpensive to manufacture, and highly efficient and reliable in performance.

Figure 2:
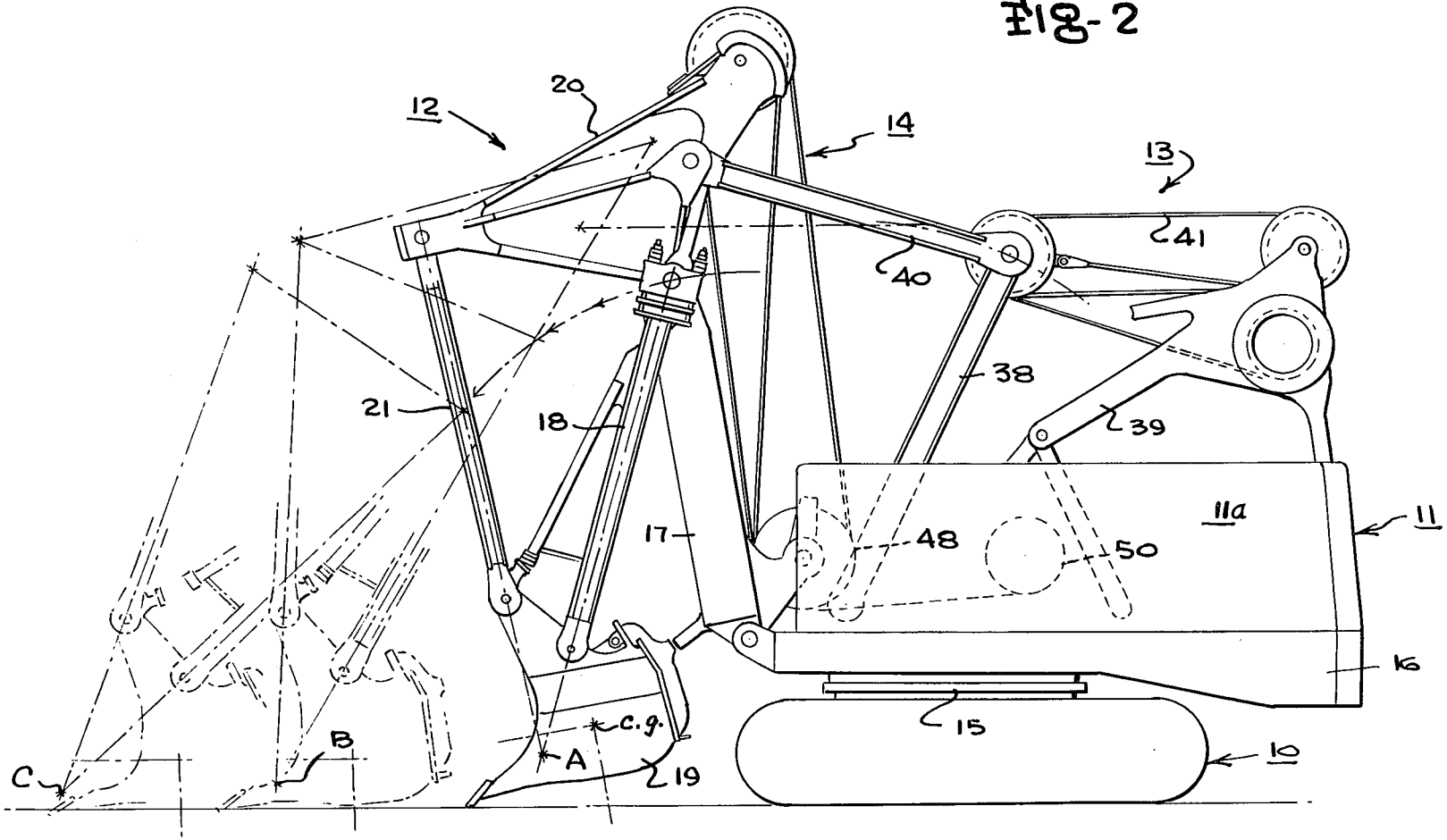
Figure 3:
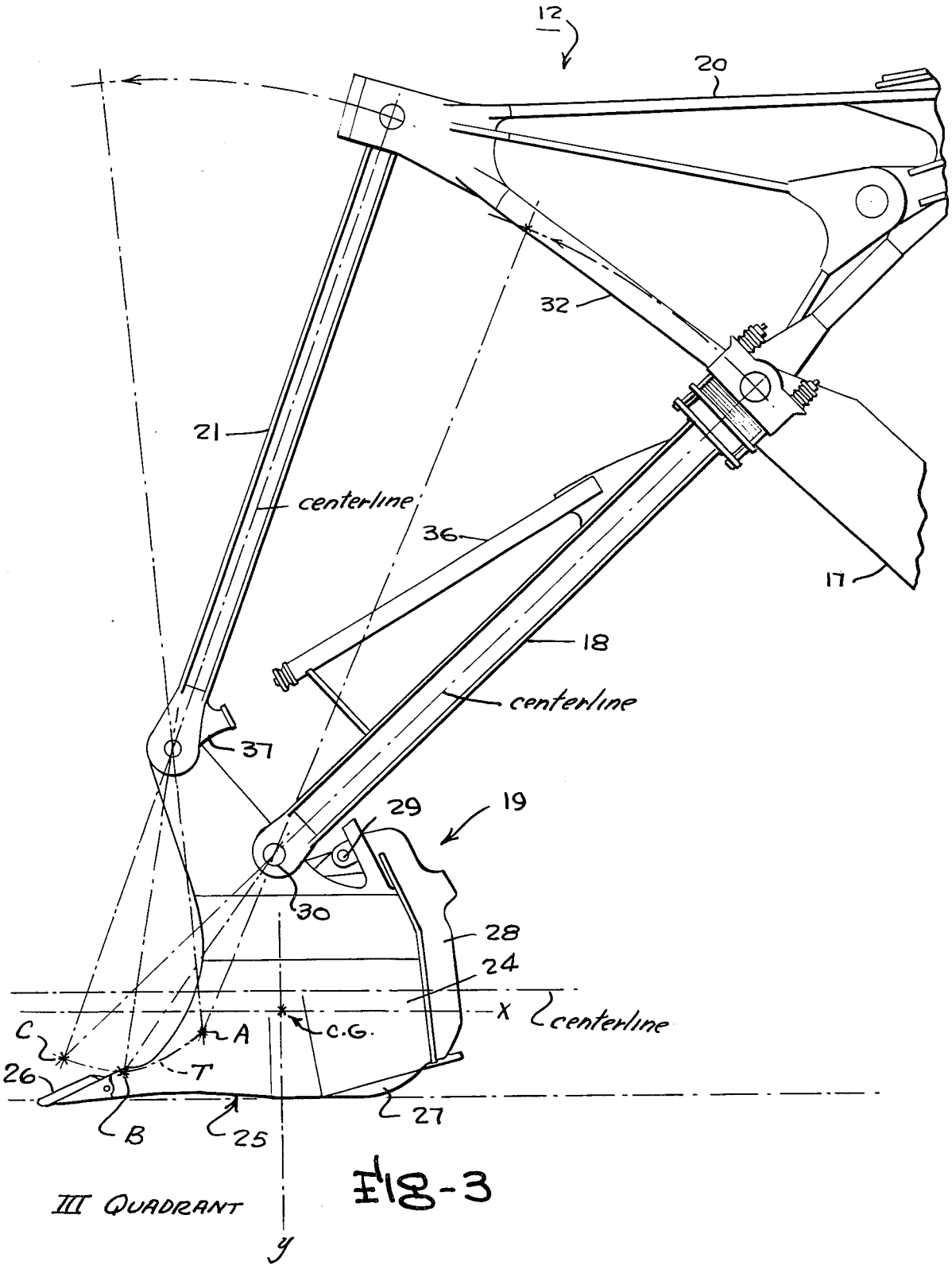

Other objects and advantages of the present invention will become more apparent to those persons having ordinary skill in the art to which the present invention pertains, from the following description taken in conjunction with the accompanying drawings, wherein:

FIG. 1 is a side elevational view of an embodiment of the invention;

FIG. 2 is a view similar to the view shown in FIG. 1, illustrating the dipper in a sequence of positions during the crowding phase of the dipping cycle of the dipper; and FIG. 3 is an enlarged, side elevational view of the front end assembly of the embodiment shown in FIGS. 1 and 2, illustrating sequential positions of the point of intersection of the centerlines of the dipper handle and hoist link during the crowding phase of the digging cycle of the dipper.

Referring to the drawings, there is illustrated an embodiment of the invention which generally includes a crawler unit 10, a main support unit 11 mounted on the crawler unit, a front end assembly 12 mounted on the front end of the main support unit, a crowd system 13 mounted on the main support unit and operatively connected to the front end assembly, a hoist system 14 mounted on the main support unit and operatively connected to the front end assembly, and a system mounted on the main support unit for operating the crowd and hoist systems.

Crawler unit 10 consists of a lower frame supported on a pair of conventional crawler assemblies, and a conventional roller circle 15 mounted on the lower frame. Main support unit 11 consists of an upper frame 16 rotatably mounted on the roller circle and a housing **11*a*** mounted on the upper frame, which houses certain components of the hoist and crowd systems and the hoist, crowd and swing machinery mounted on the upper frame.

Front end assembly 14 generally includes a stiffleg 17, a dipper handle 18, a dipper 19, a hoist frame 20 and a hoist link 21. As best illustrated in FIG. 1, the lower end of stiffleg 17 is bifurcated and pivotally connected to the front end of upper frame 16 by a pair of foot pins 22, and dipper handle 18 is pivotally connected to the opposite end of the stiffleg by means of a head shaft 23. Dipper 19 is substantially of a conventional construction, including a pair of side walls 24, a bottom wall 25 having a forwardly disposed digging or cutting edge provided with a plurality of teeth 26 and a rearwardly disposed heel portion 27, and a door 28 pivotally connected at the upper end thereof the dipper side walls as at 29 and detachably latched at the opposite end thereof to the bottom wall of the dipper.

Hoist frame 20 has substantially a triangular configuration and includes a base portion 31, a post portion 32 being disposed substantially perpendicular to base portion 31 and a tension portion 33 integrally interconnecting the upper end of post member 32 and the rear end of base portion 31. The hoist frame is pivotally mounted on head shaft 23 at an apex thereof formed by base portion 31 and post portion 32. Hoist link 21 interconnects the hoist frame and the dipper having one end thereof pivotally connected as at 34 to an apex of the hoist frame formed by post portion 32 and tension portion 33, and the opposite end thereof pivotally connected to projecting portions of the dipper side walls as at 35. It will be noted that the dipper handle, dipper, hoist link and post portion 32 of the hoist frame define a four bar linkage pivotally mounted on the head shaft provided on the outer end of the stiffleg. The geometry of such four bar linkage is such that the dipper will be biased to pitch the front end thereof upwardly relative to the dipper handle. Such upward pitching motion of the dipper is restrained by a pitch stop 36 which is engaged by a pair of abutments 37 mounted on the lower end of the hoist link when the forward end of the dipper pitches upwardly. In this regard, it is to be understood that abutments 37 also could be mounted on the side walls of the dipper. Also, other means for limiting or restraining the upward pitch of the dipper relative to the dipper handle could be used.

Crowd system 13 includes a mast 38 pivotally connected at a lower end thereof to upper frame 16, a gantry 39 rigidly mounted on upper frame 16, a pair of connecting links 40 and a crowd rope 41. As shown in FIGS. 1 and 2, crowd rope 41 is dead ended at one end thereof to the upper end of mast 38 as at 42, extends rearwardly and around a sheave 43 mounted on the upper end of gantry 39, extends forwardly and around a sheave 44 mounted on the upper end of mast 38, again extends rearwardly and around sheave 43 and forwardly and around sheave 44 and then extends rearwardly and is wound on a crowd drum 45 mounted on gantry 39. Connecting links 40 are pivotally connected at rearward ends thereof to the upper end of mast 38 and at the forward ends thereof to hoist frame 12. It thus will be seen that whenever the crowd rope is payed out, the weight of the front end assembly will crowd the dipper forwardly and when the crowd rope is taken up, the dipper will be retracted.

Hoist system 14 generally includes a hoist rope 46 which is dead ended at one end on the hoist frame as at 47, extends downwardly and around a sheave 48 mounted at the base of the stiffleg, up and around a sheave 49 mounted on the hoist frame, down and around sheave 48 and then rearwardly where it is wound around a hoist drum 50 mounted on the upper frame. Similar to the operation of the crowd system, it is to be noted when the hoist rope is taken in, the hoist frame will be caused to pivot upwardly about the head shaft to hoist the dipper, and when the hoist line is payed out, the hoist frame will be caused to pivot in an opposite direction about the head shaft to lower the dipper.

It further will be appreciated that by taking in crowd and paying out the hoist, the dipper may be moved to the position illustrated by the solid lines in FIG. 2 which is the starting position for a digging cycle. With the dipper in the starting position as illustrated in FIG. 2, it may be cycled merely by initially paying out crowd and taking in hoist to move the dipper substantially horizontally to a position as illustrated in FIG. 1, crowding the dipper into a bank of material being loaded, continuing to take in hoist and beginning taking in crowd to hoist the dipper to a dumping condition, and then continuing taking in crowd and paying out hoist to lower the dipper to the starting position of the cycle as illustrated by the solid lines in FIG. 2.

Referring to FIG. 3, the geometry of the four bar linkage defined by the dipper handle, the dipper portion disposed between the pivotal connections of the hoist link and the dipper handle with the dipper, the hoist link and post portion 32 of the hoist frame, is such that the intersection of the longitudinal centerlines of the hoist link and dipper handle intersect at a point confined to the third quadrant of a set of coordinates having the center of gravity of the dipper and any material disposed therein defining the origin of the set of coordinates, such coordinates being parallel and perpendicular to a longitudinal centerline of the dipper and such third quadrant including the forwardly disposed digging end of the dipper. Such point of intersection also is positioned inwardly of the plane of the outer surface of wall 25 of the dipper when the dipper is in a retracted position, pitched upwardly and restrained by pitch stop 36, as illustrated by solid lines in FIG. 2. Preferably, as the dipper is moved through the sequence of positions illustrated in FIG. 2 and then is hoisted, such point of intersection is confined to a region disposed in the vicinity of the forwardly disposed digging or cutting edge of the dipper, inwardly of the plane of the outer surface of the dipper bottom wall 25. As illustrated in FIG. 3, the point of intersection would assume a position designated by the letter A when the dipper is in the fully retracted position, the position designated by the letter B when the dipper was in the position shown by the second sequence in FIG. 2, and the position designated by the letter C when the dipper was fully extended at the end of the crowd phase of the digging cycle as shown by the final sequence in FIG. 2 and also as shown in FIG. 1, thus defining a line of travel T of such point which is confined to a region in the vicinity of the front cutting or digging edge of the dipper, inwardly of the plane of the outer surface of dipper bottom wall 25.

Under circumstances where the point of intersection of the centerlines of the hoist link end and dipper handle traverses the line of travel T, the dipper will be caused to assume a substantially horizontal attitude during the crowding phase of the digging cycle as previously described, with a minimum amount of drag on heel portion 27 of the dipper, thus providing an ultimate operating condition for a shovel of the type described. It would be possible, and within the comtemplated scope of the present invention, however, to arrange the geometry of the aforementioned four bar linkage so that the point of intersection of the centerlines of the hoist link and dipper handle traverses a region further remote from the forwardly disposed cutting or digging edge of the dipper and possibly even outwardly of the bottom wall of the dipper. However, such a configuration of the linkage would result in greater instability of the dipper during the crowding thereof and increased drag on the heel of the dipper, a condition sought to be avoided. Care is required in the selection of the geometry of the linkage in that if the line of travel of the intersection point is positioned too far inwardly relative to the bottom wall of the dipper, the drag on the heel of the dipper will tend to cause the leading edge of the dipper to pitch downwardly and the trailing end thereof to pitch upwardly above grade. If the line of travel is disposed too far outwardly relative to the bottom wall of the dipper, the leading edge of the dipper will tend to climb out of the material unless the teeth are very long and pitched downwardly at a considerable angle below the bottom of the dipper.

In the operation of the embodiment as described, absolute pitch, i.e., the angle of the dipper with respect to the main support unit, tends to remain constant during a substantially horizontal digging pass at all positions past the point designated by the letter B because the heel of the dipper is then dragging on the grade line which has been established by the dipper teeth. The operator thus has indirect control over absolute pitch. Furthermore, even after the heel of the dipper begins to drag, the operator has some measure of control because his crowd drive controls the equivalent vertical component of force which would be exerted on the dipper by the machine at the intersection point, and the intersection point is relatively close to the leading edge of the dipper, especially at the end of the crowd phase of the cycle when the intersection point assumes a position designated by the letter C. By releasing the crowd faster, the operator can cause the dipper to "bite harder" and thus pitch down. Conversely, by releasing the crowd slower, he can cause the dipper to pitch upwardly.

It thus will be seen that by the selection of the proper geometry of the four bar linkage defined by the dipper handle, dipper, hoist link and hoist frame, the dipper of a machine of the type described, may be caused to maintain a substantially horizontal attitude during the crowding phase of the digging cycle of the dipper, without the use of a pitch control mechanism as disclosed in the prior art as aforementioned.

From the foregoing detailed description, it will be evident that there are a number of changes, adaptations and modifications of the present invention which will come within the province of those persons having ordinary skill in the art to which the present invention pertains. However, it is intended that all such variations not departing from the spirit of the invention be considered within the scope thereof as limited solely by the appended claims.

I claim:

1. A power shovel comprising a base unit; a support unit rotatably mounted on said base unit; a front end assembly including a stiffleg pivotally connected at a lower end thereof to said support unit, a dipper handle operatively connected to said stiffleg, a dipper having a forwardly disposed digging end pivotally connected to said dipper handle, said dipper being biased to pitch the forwardly disposed digging end thereof upwardly, means for limiting the upward pitch of the digging end of said dipper relative to said dipper handle, a hoist frame pivotally connected to said stiffleg, and a hoist link pivotally connected at the ends thereof to said hoist frame and said dipper, said dipper handle, hoist link and hoist frame defining a four bar linkage; a crowd system operatively interconnecting said support unit and said front end assembly; a hoist system operatively interconnecting said support unit and said front end assembly; and control means mounted on said support means for operating said crowd and hoist systems to crowd, hoist, lower and retract said dipper, said four bar linkage having a geometry wherein the point of intersection of the longitudinal centerlines of said hoist link and said dipper handle is confined to the lower and forwardly disposed quadrant of a set of coordinates having the center of gravity of the dipper defining the origin of the set of coordinates, said coordinates being parallel and perpendicular to a longitudinal centerline of said dipper and said quadrant thereof including said forwardly disposed digging end of said dipper, and said point of intersection is positioned inwardly of the bottom surface of said dipper when said dipper is in a retracted position, pitched upwardly and restrained by said pitch limiting means.

2. A power shovel according to claim 1 wherein said four bar linkage has a geometry wherein said point of intersection is positioned inwardly of the bottom surface of said dipper when said dipper is being hoisted, pitched upwardly and restrained by said pitch limiting means.

3. A power shovel according to claim 1 wherein said four bar linkage has a geometry wherein said point of intersection is positioned inwardly of the bottom surface of said dipper when said dipper is being crowded.

4. A power shovel according to claim 1 wherein said four bar linkage has a geometry wherein said point of intersection is positioned inwardly of the bottom surface of said dipper.

5. A power shovel according to claim 1 wherein said four bar linkage has a geometry wherein said point of intersection traverses a line of travel in close proximity to said forwardly disposed digging end of said dipper.

6. A power shovel according to claim 5 wherein said four bar linkage has a geometry wherein said line of travel is disposed inwardly of the bottom surface of said dipper when said dipper is being hoisted, pitched upwardly and restrained by said pitch limiting means.

7. A power shovel according to claim 5 wherein said four bar linkage has a geometry wherein said line of travel is disposed inwardly of the bottom surface of said dipper when said dipper is being crowded.

8. A power shovel according to claim 5 wherein said four bar linkage has a geometry wherein said line of travel is disposed inwardly of said forwardly disposed digging end of said dipper.

9. A power shovel according to claim 1 wherein said pitch limiting means comprises a stop element mounted on said dipper handle, engagable by an abutment disposed on one of said hoist link and said dipper when said dipper pitches upwardly.

10. A power shovel comprising a base unit; a support unit rotatably mounted on said base unit; a front end assembly including a stiffleg pivotally connected at a lower end thereof to said support unit, a dipper handle operatively connected to said stiffleg, a dipper having a forwardly disposed digging end pivotally connected to said dipper handle, said dipper being biased to pitch the forwardly disposed digging end thereof upwardly, means for limiting the upward pitch of the digging end of said dipper relative to said dipper handle, a hoist frame pivotally connected to said stiffleg, and a hoist link pivotally connected at the ends thereof to said hoist frame and said dipper, said dipper handle, hoist link and hoist frame defining a four bar linkage; a crowd system operatively interconnecting said support unit and said front end assembly; a hoist system operatively interconnecting said support unit and said front end assembly; and control means mounted on said support means for operating said crowd and hoist systems to crowd, hoist, lower and retract said dipper, said four bar linkage having a geometry wherein the point of intersection of the longitudinal centerlines of said hoist link and said dipper handle is confined to the lower and forwardly disposed quadrant of a set of coordinates having the center of gravity of the dipper defining the origin of the set of coordinates, said coordinates being parallel and perpendicular to a longitudinal centerline of said dipper and said quadrant thereof including said forwardly disposed digging end of said dipper, and said point of intersection is positioned inwardly relative to the bottom surface of said dipper when said dipper is being hoisted, pitched upwardly and restrained by said pitch limiting means.

11. A power shovel according to claim 10 wherein said four bar linkage has a geometry wherein said point of intersection is positioned inwardly of the bottom surface of said dipper when said dipper is being crowded.

12. A power shovel accordingly to claim 10 wherein said four bar linkage has a geometry wherein said point of intersection is disposed inwardly of the bottom surface of said dipper.

13. A power shovel according to claim 10 wherein said four bar linkage has a geometry wherein said point of intersection traverses a line of travel in close proximity to said forwardly disposed digging end of said dipper.

14. A power shovel according to claim 10 wherein said pitch limiting means comprises a stop element mounted on said dipper handle, engagable by one of said hoist link and said dipper when said dipper pitches upwardly.

* * * * *